US010989472B2

(12) United States Patent
Malachowski et al.

(10) Patent No.: US 10,989,472 B2
(45) Date of Patent: Apr. 27, 2021

(54) METHOD, APPARATUS AND SYSTEM FOR FLUID COOLING OF TONER DRYER

(71) Applicant: Xerox Corporation, Norwalk, CT (US)

(72) Inventors: Steven M. Malachowski, East Rochester, NY (US); Matthew M. Storey, Rochester, NY (US); Eric David Godshall, Macedon, NY (US); Peter J. Schmitt, Webster, NY (US); Michael P. Dugan, Batavia, NY (US); Daniel Mcdougall Mcneil, Georgetown (CA); David R. Earle, Churchville, NY (US); Edmund T. Varga, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 191 days.

(21) Appl. No.: 15/498,888

(22) Filed: Apr. 27, 2017

(65) Prior Publication Data

US 2018/0314195 A1 Nov. 1, 2018

(51) Int. Cl.
*F26B 3/10* (2006.01)
*G03G 15/08* (2006.01)

(52) U.S. Cl.
CPC ..... *F26B 3/10* (2013.01); *G03G 15/08* (2013.01)

(58) Field of Classification Search
CPC ..... F26B 3/10; G03G 15/08
USPC ..... 34/493
See application file for complete search history.

(56) References Cited

U.S. PATENT DOCUMENTS 3,333,692 A * 8/1967 Eveson ..... F26B 3/08 209/474
3,632,257 A 1/1972 Ashizawa
3,854,224 A * 12/1974 Yamaji ..... G03G 15/107 34/77
4,245,396 A 1/1981 Maffet
4,251,367 A 2/1981 Santora
4,489,503 A 12/1984 Browne et al.
4,736,527 A 4/1988 Iwamoto et al.
4,753,633 A 6/1988 Callegari, Sr. et al.
4,916,829 A * 4/1990 Takiue ..... F26B 13/10 34/446
5,007,181 A 4/1991 Jackson et al.
5,032,222 A 7/1991 Millioud
5,350,659 A 9/1994 Lee et al.
6,207,339 B1 3/2001 Kato et al.
6,745,493 B2 6/2004 Malachowski et al.
6,931,950 B2 8/2005 Malachowski et al.
7,238,459 B2 7/2007 Malachowski
7,439,004 B2 10/2008 Malachowski et al.
7,476,480 B2 1/2009 Malachowski et al.
8,080,360 B2 12/2011 Marcello et al.
8,101,331 B2 1/2012 Fan et al.
8,162,293 B2 * 4/2012 Goldmann ..... F24F 5/0035 261/115
8,383,311 B2 2/2013 Cheng et al.
9,052,625 B2 6/2015 Chung et al.
(Continued)

OTHER PUBLICATIONS

U.S. Appl. No. 14/958,838, filed Dec. 3, 2015, Croteau et al.

*Primary Examiner* — Jessica Yuen
(74) *Attorney, Agent, or Firm* — Fay Sharpe LLP

(57) ABSTRACT

Disclosed is a method, apparatus and system of drying wet toner particles which includes the use of cooling fluid. The method also includes introducing a heated drying gas into a toner drying chamber to create a circulating flow of drying gas.

20 Claims, 9 Drawing Sheets

(56) References Cited

U.S. PATENT DOCUMENTS

| | | | |
|---|---|---|---|
| 9,086,641 | B2 | 7/2015 | Malachowski et al. |
| 9,187,605 | B2 | 11/2015 | Wang et al. |
| 9,223,237 | B2 | 12/2015 | Chung et al. |
| 9,267,032 | B1 | 2/2016 | Li et al. |
| 9,372,421 | B2 | 6/2016 | Malachowski et al. |
| 2014/0302432 | A1 | 10/2014 | Chung et al. |
| 2014/0302436 | A1 | 10/2014 | Chung et al. |
| 2016/0004175 | A1 | 1/2016 | Li et al. |

* cited by examiner

TABLE 1

| MODE | OPERATING MODE DESCRIPTION | TIC1 | | | TIC2 | | |
|---|---|---|---|---|---|---|---|
| | | MANUAL/ AUTO | SP CONTROL | OUTPUT CONTROL | MANUAL/ AUTO | SP CONTROL | OUTPUT CONTROL |
| 1 | START DRYING | AUTO | RAMP TO TARGET | AUTO | MANUAL | NO | 0% |
| 2 | PREHEAT DRYER BY FALSE LOAD | MANUAL | NO | 0% | AUTO | RAMP TO TARGET | AUTO |
| 3 | START DRYING FROM FALSE LOAD | AUTO | SP=TARGET | AUTO | MANUAL | NO | RAMP TO 0% |
| 4 | SWITCH FROM DRYING TO FALSE LOAD | MANUAL | NO | RAMP TO 0% | AUTO | SP=TARGET | AUTO |
| 5 | SHUTDOWN FROM DRYING | AUTO | RAMP TO 0-DEG C | AUTO | MANUAL | NO | |
| 6 | SHUTDOWN FROM FALSE LOAD | MANUAL | NO | 0% | AUTO | RAMP TO 0-DEG C | AUTO |

FIG. 6

TABLE 2

| MODE | OPERATING MODE DESCRIPTION | TIC INLET | | | TIC-001 | | | TIC-002 | | |
|---|---|---|---|---|---|---|---|---|---|---|
| | | MANUAL/ AUTO | SP CONTROL | OUTPUT CONTROL | MANUAL/ AUTO | SP CONTROL | OUTPUT CONTROL | MANUAL/ AUTO | SP CONTROL | OUTPUT CONTROL |
| 1 | START DRYING | AUTO | RAMP UP TO TARGET | AUTO | AUTO | SP=OUTLET TARGET | AUTO | MANUAL | NO | 0% |
| 2 | PREHEAT DRYER BY FALSE LOAD | AUTO | RAMP UP TO TARGET | AUTO | MANUAL | NO | 0% | AUTO | SP=OUTLET TARGET | AUTO |
| 3 | START DRYING FROM FALSE LOAD | AUTO | HOLD TARGET | AUTO | AUTO | SP=OUTLET TARGET | AUTO | MANUAL | NO | RAMP TO 0% |
| 4 | SWITCH FROM DRYING TO FALSE LOAD | AUTO | HOLD TARGET | AUTO | MANUAL | NO | RAMP TO 0% | AUTO | SP=OUTLET TARGET | AUTO |
| 5 | SHUTDOWN FROM DRYING | AUTO | CONTROLLED COOL DOWN | AUTO | AUTO | SP=OUTLET TARGET | AUTO | MANUAL | NO | 0% |
| 6 | SHUTDOWN FROM FALSE LOAD | AUTO | CONTROLLED COOL DOWN | AUTO | MANUAL | NO | 0% | AUTO | SP=OUTLET TARGET | AUTO |

FIG. 8

METHOD, APPARATUS AND SYSTEM FOR FLUID COOLING OF TONER DRYER

BACKGROUND

The present disclosure relates to a method, apparatus and system of drying toner particles, and more particularly a method, apparatus and system for drying chemical toner particles in a circulating flow of drying gas, according to an exemplary embodiment.

Toner used in printers and copiers includes toner particles which are applied to paper to produce an image. It is desirable that the toner particles be uniformly sized, having a narrow size distribution, to produce images with improved resolution and clarity. For example, in one known application, solid toner particles are produced having a typical average size distribution of approximately 6 microns in diameter with most particles falling in a range of about 2 to 8 microns.

It is also desirable that the toner particles flow freely during the production of an image on a media sheet, such as paper. Moisture retained by the toner particles can cause the particles to stick together and not flow freely. During the process of manufacturing toner, the toner particles are dried until they have a moisture content sufficiently low enough that the toner particles do not stick together.

During toner manufacturing, toner particles are separated from each other in a process called deagglomeration. During drying, sufficient deagglomeration exposes the surface of each particle to enable efficient heat transfer from the particle which also aids in drying.

In a conventional process of forming chemical toner, latex particles and pigment particles are heated in a chemical reactor to form covalent bonds between the particles. The covalent bonds provide attractive forces between the particles causing them to come together or aggregate. The aggregated particles are then coalesced to make them more robust.

At this point in the process, the particles are in a liquid dispersion, also known as a mother liquor, which includes the toner particles, as well as residuals such as latex, pigment, surfactants, and other materials used in the process. Next, the mother liquor is dewatered from the particles to obtain a slurry including the solid toner particles as well as residuals including surfactants used to stabilize the latex, pigments and waxes. This wetcake is then washed to remove more of the residuals. The wetcake may be washed several times.

The washed toner particles, or wetcake, is then dried to provide free-flowing individual toner particles. Several different processes have been used for drying the toner particles, including indirect dryers such as disc dryers, drum dryers, paddle dryers, rotary dryers, and direct dryers including vacuum, freeze fluid bed and conveyers.

The wetcake includes a large number of different sized wet toner particles. Further, the moisture retained by each wet particle is typically proportional to the particle size, so that larger particles retain more moisture than smaller particles. A toner drying process described in U.S. Pat. No. 6,745,493 provides a method of drying toner including the use of a toroidal shaped drying chamber using an injected air flow to efficiently dry the various sizes of toner particles, where moisture is removed in an effective and efficient manner.

Toner particles heated above their glass transition point (Tg) or melting point (Tm), can fuse with other particles. The fused toner particle clumps have sizes which exceed the desired range of particle size resulting in poor toner performance. It is desirable to dry each toner particle to remove the desired amount of moisture while preventing overheating which can result in the undesirable fusion of toner particles.

INCORPORATION BY REFERENCE

U.S. Pat. No. 6,745,493, issued Jun. 8, 2004, by Malachowski et al., and entitled "SYSTEM AND METHOD FOR DRYING TONER PARTICLES";

U.S. Pat. No. 7,238,459, issued Jul. 3, 2007, by Malachowski, and entitled "METHOD AND DEVICE FOR PROCESSING POWDER";

U.S. Pat. No. 7,439,004, issued Oct. 21, 2008, by Malachowski et al., and entitled "METHODS FOR WASHING AND DEWATERING TONER";

U.S. Pat. No. 8,080,360, issued Dec. 20, 2011, by Marcello et al., and entitled "TONER PREPARATION PROCESSES";

U.S. Pat. No. 8,101,331, issued Jan. 24, 2012, by Fan et al., and entitled "METHOD AND APPARATUS OF RAPID CONTINUOUS PROCESS TO PRODUCE CHEMICAL TONER AND NANO-COMPOSITE PARTICLES";

U.S. Pat. No. 9,052,625, issued Jun. 9, 2015, by Chung et al., and entitled "METHOD OF CONTINUOUSLY FORMING AN AQUEOUS COLORANT DISPERSION USING A SCREW EXTRUDER";

U.S. Pat. No. 9,086,641, issued Jul. 21, 2015, by Malachowski et al., and entitled "TONER PARTICLE PROCESSING"; and U.S. Patent Publication No. 2014/0302432, published Oct. 9, 2014, by Chung et al., and entitled "CONTINUOUS COALESCENCE PROCESSES", are incorporated herein by reference in their entirety.

BRIEF DESCRIPTION

In one embodiment of this disclosure, described is a toner drying apparatus comprising: a toner drying chamber including one or more curved inner radius portions; one or more drying gas inlets operatively connected to the toner drying chamber adapted to provide drying gas at a first temperature into the toner drying chamber and generate a circulating flow of chamber gas within the toner drying chamber; a toner feed inlet operatively connected to the toner drying chamber, the toner feed inlet adapted to feed wet toner particles into the circulating flow of chamber gas; one or more cooling fluid inlets operatively connected to the toner drying chamber adapted to provide cooling fluid at a second temperature less than the drying gas first temperature circulating flow of the chamber gas within the toner drying chamber; a toner outlet operatively connected to the toner drying chamber, the toner outlet adapted to direct an exiting stream of the chamber gas from the drying chamber generating exiting forces on dry toner particles in the circulating flow of chamber gas thereby transporting the dry toner particles from the toner drying chamber; and a controller operatively associated with the one or more drying gas inlets and the one or more cooling fluid inlets, the controller configured to control one or both of a flow rate and the second temperature of the cooling fluid provided into the toner drying chamber, thereby effecting a change in a temperature of the circulating flow of the chamber gas within the toner drying chamber.

In another embodiment of this disclosure, described is a toner drying process comprising: generating a circulating flow of chamber gas within a toner drying chamber including one or more curved inner radius portions, the drying chamber gas generated by a combination of drying gas at a first temperature injected into the toner drying chamber and a cooling fluid at a second temperature injected into the toner drying chamber; feeding wet toner particles into the circulating flow of chamber gas, thereby circulating the wet toner particles within the toner dryer chamber drying the wet toner particles, and deagglomerating the wet toner particles; providing an exiting stream of the chamber gas from a toner outlet operatively associated with the toner drying chamber, the exiting stream including dried and deagglomerated toner particles.

In still another embodiment of this disclosure, described is a toner dryer comprising: a toroidal shaped toner drying chamber including a plurality of curved inner radius portions; a plurality of drying air inlets operatively connected to the toner drying chamber adapted to provide drying air at a first temperature into the toner drying chamber and generate a circulating flow of chamber air within the toner drying chamber; a toner feed inlet operatively connected to the toner drying chamber, the toner feed inlet adapted to feed wet toner cakes into the toner drying chamber; a plurality of cooling fluid inlets operatively connected to the toner drying chamber adapted to inject water mist at a second temperature less than the first temperature into the toner drying chamber and into the circulating flow of the chamber air; a toner outlet operatively connected to the toner drying chamber, the toner outlet adapted to direct an exiting stream of the chamber air from the drying chamber generating exiting forces on dryer toner particles in the circulating flow of chamber air thereby transporting the dry toner particles from the toner drying chamber; and a controller operatively associated with the plurality of drying air inlets and the plurality of cooling fluid inlets, the controller configured to control a flow rate and the second temperature of the injected water mist into the toner drying chamber, thereby effecting a change in a temperature of the circulating flow of the chamber air within the toner drying chamber.

BRIEF DESCRIPTION OF THE DRAWINGS

FIG. 6 includes Table 1 which provides dryer modes of operation associated with the toner feeder and dryer system shown in FIG. 5;

FIG. 8 includes Table 2 which provides dryer modes of operation associated with the toner feeder and dryer system shown in FIG. 7.

DETAILED DESCRIPTION

Figure 1:
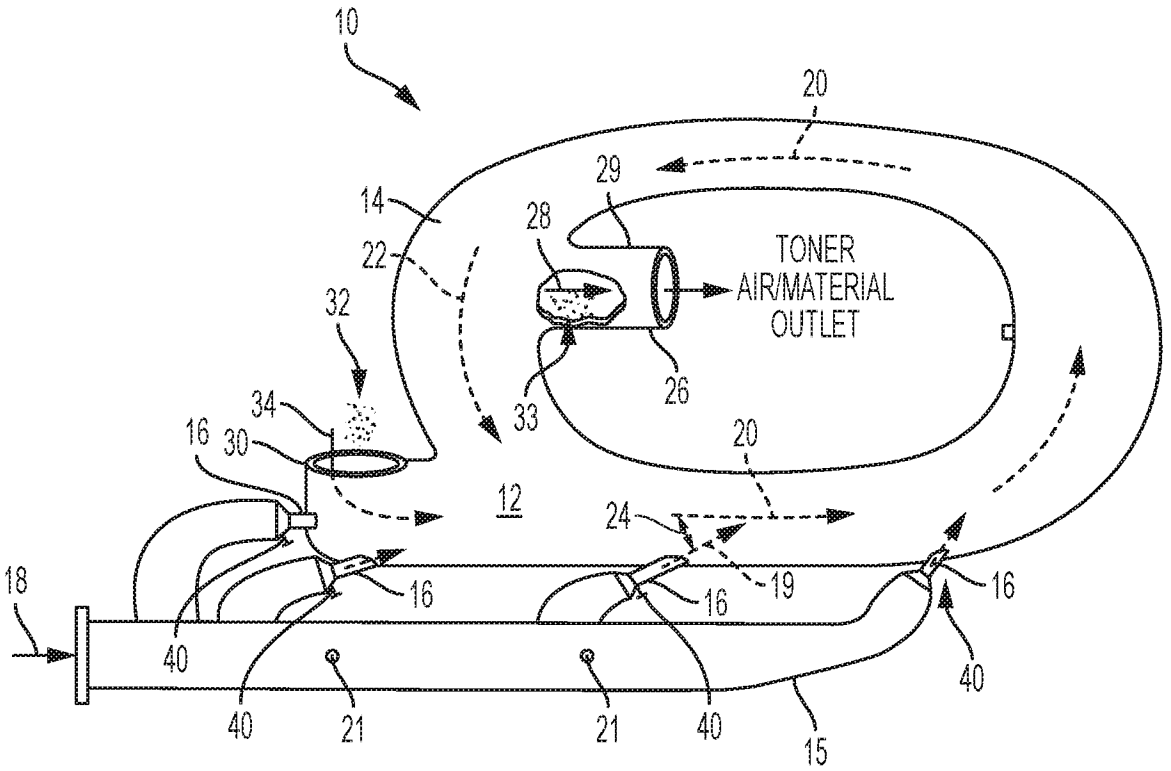
FIG. 1 is diagram illustrating a toner dryer according to an exemplary embodiment of this disclosure.

This disclosure and the exemplary embodiment described herein, provides the use of individual spray nozzles to inject water inside the chamber of a toroidal dryer used for drying Emulsion Aggregation (EA) particles. The temperature inside the dryer is controlled by the moisture content of the EA particle wet cake, the feed rate of the cake, and also the rate of the air inside the dryer and its initial temperature. Thermal conditions during start-up and shut down of the drying system can be unstable. Also, sudden changes in the wet cake moisture content and feed rate can lead to variability in the thermal conditions inside the dryer, which in some cases can lead to higher than optimal temperature that in turn cause fusing of the toner on the internal walls of the dryer. In extreme cases, the product quality can be compromised due to coarse particles. The injection of fluid, such as water, inside the dyer leads to a reduction in temperature of the air when needed. In addition, temperatures are continuously monitored and the water injection rate can be adjusted as needed to attain the desired internal temperature in the dryer. Testing of different nozzles in manual mode have shown to be effective in driving temperature down in the absence of wet cake.

Conventionally, a toroidal dryer design works by simultaneously metering in toner (in a semi-wet "cake" form) at a calculated rate while introducing and continuously circulating, high velocity, heated air to remove moisture from the product. The relationship between the rate of wet toner introduced and the temperature/flow rate of air is very critical. Too much material will oversaturate the system but too little material will slow throughput and require waiting time for the airflow to ramp down and the dryer temperature to cool. Overheating the dryer can cause quality problems with the product in the form of fused particles, resulting in print defects and equipment failure. According to the conventional toroidal dryer design, the dryer is cooled through the introduction of more wet toner, which due to unavoidable upstream or downstream delays in production, may not always be available.

According to an exemplary embodiment of this disclosure, individual water spray nozzles are welded onto the inlet air nozzles of a toroidal dryer. The water spray nozzles are automatically controlled with actuated valves via a control system that monitors product in the dryer as well as air temperatures, air flow, and other variables. The spray is a fine, atomized mist of low pressure, RO (Reverse Osmosis) water. This water serves to significantly reduce the air and dryer wall temperatures when needed, thereby eliminating the need to shut off or slow down the dryer, which takes up potential toner drying processing time. If the dryer is not cooled down when toner product is not being added, the toner contained within the dryer overheats and fuses to the dryer walls and/or nozzles. This fusing condition prevents the dryer from operating optimally or even at all, and also potentially introduces coarse, fused toner particles in the final toner product that eventually leads to print defects.

Water (RO, Deionized, Distilled, Soft, or domestic) Injection is used to substitute for the loss of feed wet cake (particle/water) into the dryer toroid during a chemical toner drying process according to an exemplary embodiment of this disclosure. This eliminates the need for the dryer to go into shutdown mode in the event that toner feed needs to be reduced or stopped completely, saving cycle time, enabling future increases in throughput, and preventing major changeover issues. Specific uses of the disclosed toner dryer apparatus/method/system includes:

1) During a requested intermittent feed disruption—personnel at the subsequent toner blending step stop the dryer feed because of an issue with the blend rate keeping up with the dryer rate. The disclosed system will eliminate the need to ramp down and ramp back up the dryer, which would decrease the overall throughput if required.

2) During wet cake "low weight" feed condition in the dryer, the dryer feeder reaches a low weight or becomes empty, and the disclosed system eliminates the need to automatically shut down the dryer to prevent fusing in the dryer system, thereby eliminating a reduction in the toner production rate.

3) Upon any abrupt mechanical failure that could disrupt toner feed to the dryer (i.e., feeder, rotary valve), an unplanned loss of feed occurs while the dryer is operating at a temperature, which can cause a rapid increase in system temperature and fusing of nozzles, toroid wall, exit pipe, and ductwork. The dust collector can also be impacted for severe occurrences and certain programs where inlet temperatures are highest. The disclosed dryer prevents a rapid increase in system temperature thereby preventing fusing.

4) During a final shutdown operation at the end of the campaign, the dryer needs to ramp down at end of a campaign to account for residual heat in dryer system. The disclosed systems enable a controlled ramp down period of the dryer to prevent fusing.

5) Without a dryer cooling system as disclosed herein, there is a limitation to the temperature and amount of heat that can be introduced into a toner dryer system which produces an overall lower throughput rate. This is due to the risk of residual heat fusing any toner which has built up in the dryer system. With additional cooling system protection, the dryer can run an overall higher throughput rate with no concern for fusing.

It is to be understood that the specific devices and processes illustrated in the attached drawings, and described in the following specification are exemplary embodiments. Hence, specific examples and characteristics relating to the embodiments disclosed herein are not to be considered as limiting, unless the claims expressly state otherwise.

A method, apparatus and system for drying chemical toner particles, such as emulsion aggregate chemical toner particles including styrene-acrylate toner particles, polyester toner particles or any other suitable known toner particles is provided. The chemical toner particles are typically uniformly sized with the majority having a diameter falling into a predetermined range. As an example, which should not be considered limiting, the disclosure can be used to dry wet toner particles having sizes between 2 and 8 microns, although any suitable sizes of known toner particles can be used. The wet toner particles can be produced in any known manner and can have any suitable conventional moisture content, often expressed as a percent by weight of moisture. One example of the moisture content of the wet toner particles, which should not be considered as limiting, can be about 20% to about 40% by weight, and more preferably from about 25% to about 35% by weight, although any suitable moisture content can be used.

Referring to FIG. 1 a dryer for drying toner particles is shown generally at 10. The dryer 10 includes a drying chamber 12 in which the toner particles are dried. The drying chamber includes a curved portion 14 and can have a circular shape, a toroidal shape or any other suitable shape having a curved portion. Toroidal dryers have been used to dry materials such as waste products. However, these toroidal dryers have not been used to dry heat sensitive materials, having melting points $T_m$ and glass transition points $T_g$ which adversely affect the resulting dried products.

The dryer 10 further includes at least one drying gas inlet 16 extending into the drying chamber 12 for introducing heated drying gas, shown by arrow 19, into the drying chamber 12 to produce a circulating flow of drying gas shown generally by arrow 20. According to an exemplary embodiment, a manifold 15 is operatively associated with distributing heated drying gas to a plurality of the drying gas inlets 16. Misting nozzles 40 are coupled to the drying gas inlets 16 and water supply lines (not shown) to inject water to generate a heated gas mist which is injected into the drying chamber 12.

The drying gas 18 is heated to a pre-determined temperature and pressurized to create a high velocity circulating flow 20. The pressure and temperature of the drying gas 18 can be monitored at monitor points 21. Temperatures of about 15 degrees Celsius (° C.) to about 40° C. above the exiting stream temperature (as described below), and more preferably about 20° C. to about 35° C. above the exiting stream temperatures have been found to be effective, although any suitable inlet stream temperatures can be used. Inlet pressures from about 1.0 pounds per square inch psi) to 5.0-psi, and more preferably from about 1.0-psi to 1.5-psi have been shown to provide suitable circulating flow velocities, although any suitable inlet pressures can be used. Flow velocities of about 3,000 feet per minute (fpm) to 5,000 fpm, and more preferably 3,800 fpm to 4,200 fpm have been found to be effective for drying and deagglomerating the wet toner particles 32, although any suitable flow velocities can be used.

The drying gas inlet 16 is preferably angled with respect to the circulating flow 20 as shown at 24 to produce the circulating flow. The angle 24 is preferably less than 90 degrees, although any suitable angle, including an angle of 0 degrees may be used. The circulating flow 20 circulates in the drying chamber 12 in a circular flow as shown by the arrows 20 and 22. The circulating flow 20 includes a curved portion 22 flowing through the curved portion 14 of the drying chamber 12.

The dryer 10 includes an exit path 26 communicating with the drying chamber 12 for directing an exiting stream of the drying gas and dried toner material, shown by arrow 28, out of the drying chamber 12. The exit path 26 extends at approximately a right angle from the curved portion 14 of the drying chamber so that the exiting stream 28 forms an angle with the curved portion 22 of the circular flow. The angle can be approximately a right angle, although it has been found that varying this angle can create or reduce turbulence and affect the material cut point by size or mass. Accordingly, any suitable angle size may be used to produce the results desired.

The dryer 10 also includes a feed inlet 30 for introducing a feed of wet toner particles 32 into the circulating flow of drying gas 20 within the drying chamber 12 as shown by arrow 34 for drying. Any suitable known method and/or apparatus can be used for introducing the feed of wet toner particles 32, such as for example, a rotary valve or Venturi injection.

Figure 2:
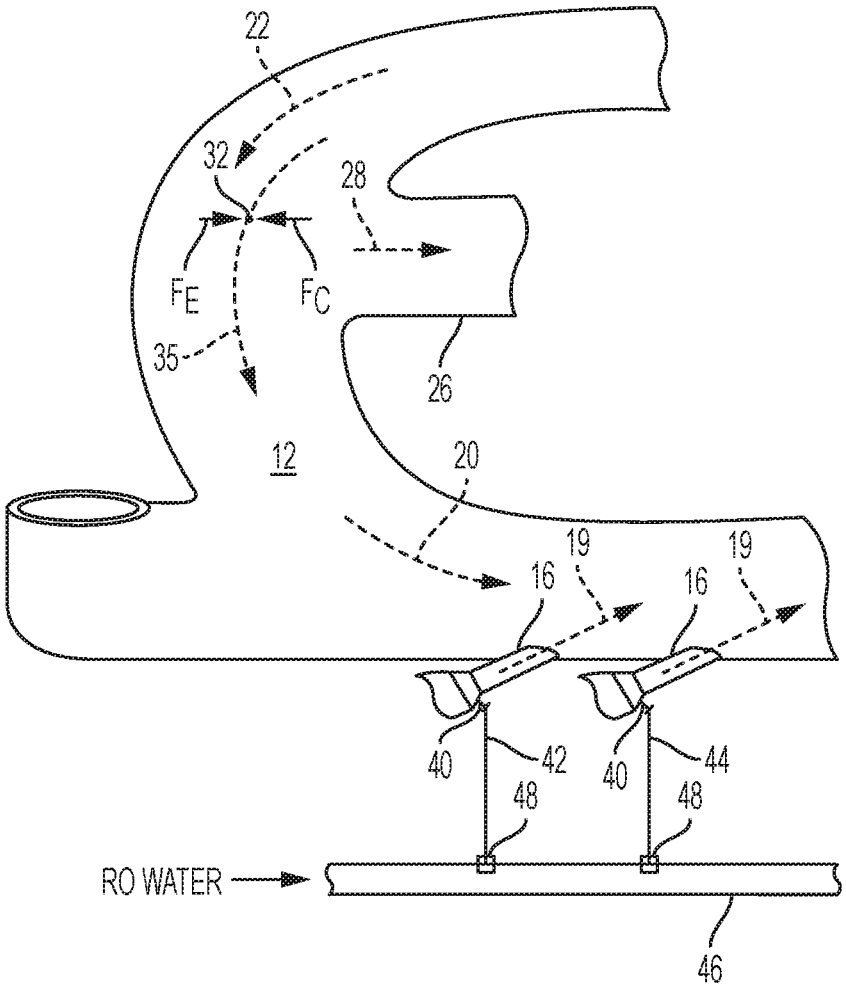
FIG. 2 is diagram of a portion of the toner dryer show in FIG. 1 illustrating the forces exerted on a toner particle when the toner particle remains in a circulating stream in accordance with an exemplary embodiment of this disclosure.
Figure 3:
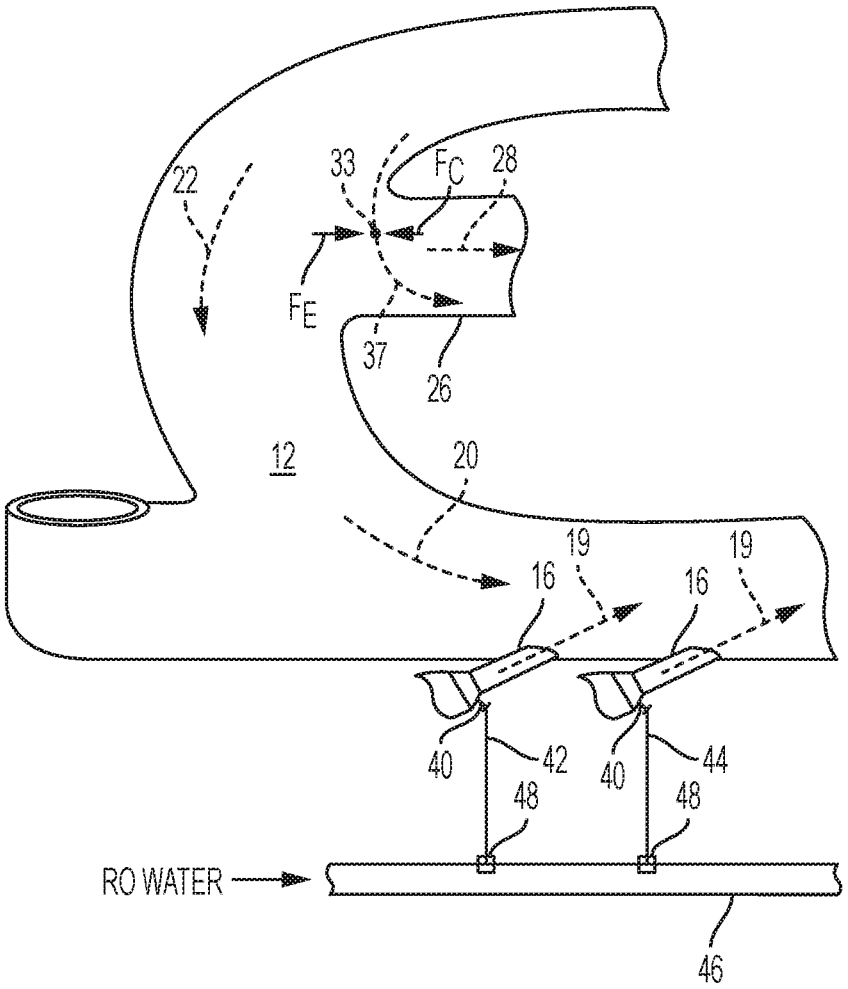
FIG. 3 is diagram of a portion of the toner dryer show in FIG. 1 illustrating the forces exerted on a toner particle when the toner particle exits the drying chamber in accordance with an exemplary embodiment of this disclosure.

Referring now to FIGS. 2 and 3, the operation of the dryer 10 shall be further described. The feed of wet toner particles 32 introduced into the feed inlet 30 are carried through the drying chamber 12 by the circulating flow of drying gas 20. The circulating flow of drying gas is generated by a heated drying gas delivery system as previously described with reference to FIG. 1. As shown in FIG. 2 and FIG. 3, water misting nozzles 40 coupled to water lines 40, couplers 48 and a water supply line inject a misted heated drying gas into the drying chamber 12. The circulating flow 20 deagglomerates the feed of wet toner particles 32 separating them into individual particles. The wet toner particles 32 are flash dried while they remain in the circulating flow of drying gas 20 within the drying chamber 12 for the drying time $T_D$. Evaporative cooling helps protect the particles from fusing together.

As the wet toner particles 32 travel through the curved portion 14 of the drying chamber 12 in the curved portion of the circulating flow 22, centrifugal forces $F_C$ are produced on the toner particles. Further, as the toner particles 32 in the curved flow 22 travel past the exiting stream 28, exiting forces $F_E$ such as centripetal forces due to frictional drag from the exit stream 26, are produced on the particles. The exiting forces $F_E$ urge the particles to move into the exiting stream 28 and be carried through the exit path 26 and out of the drying chamber 12. The exit path 26 is constructed an form an angle of approximately 90 degrees with the curved portion 14 so that the exiting stream 28 is forms an angle of approximately 90 degrees with the curved flow 22. As a result, the centrifugal forces $F_C$ on the particles oppose the exiting forces $F_E$, although, as stated above, angles of other magnitudes can be used.

Wet toner particles 32 have more mass than similarly sized dry toner particles because they retain more water. Therefore, the wet toner particles 32 traveling around the curved portion 14 in the curved flow 22 experience greater centrifugal forces $F_C$ than dry toner particles. The larger centrifugal forces $F_C$ exerted on the wet toner particles 32 overcome the exiting forces $F_E$ exerted on these particles and keep the wet toner particles in the circulating flow of drying gas 22 for further drying as shown by the dashed arrow 35.

As the toner particles dry, they retain less water and thus have less mass. As the mass of the drying toner particle decreases, the centrifugal forces $F_C$ exerted on the toner particles in the curved portion of the circulating flow 22 decreases. When the toner particles are dry, as shown at 33, having a predetermined desired moisture content the centrifugal forces $F_C$ no longer are large enough to overcome the exiting forces $F_E$ and keep the toner particles in the circulating flow of drying gas within the drying chamber 12 of the dryer 10. The exiting forces $F_E$ urge the dry toner particles 33 to move into the exiting stream 28 and be carried out of the drying chamber 12 as shown by the dashed arrow 37. The dry toner particles 33 are collected from the exiting stream 28 by cyclonic collection methods, using a bag house or dust collector, or in any suitable known manner of collecting particles from a flowing stream of gas.

Each of the particles remains in the circulating flow 20 in the drying chamber 12 for the drying time $T_D$ which can vary from particle to particle. The drying time $T_D$ for each wet toner particle is proportional to the mass of the toner particle. The mass of each wet toner particle 32 includes the mass of the toner particle and the mass of the water retained by the toner particle.

The drying time $T_D$ for each toner particle is thus proportional to the size of the toner particle so that a larger toner particle is dried for a longer drying time than a smaller toner particle. Further, since the amount of moisture retained by the toner particle is proportional to the size of the toner particle, the drying time $T_D$ is generally proportional to the amount of moisture retained by the toner particle. Therefore, a toner particle retaining more water is dried for a longer drying time than a toner particle retaining less water.

The exiting stream 28 is monitored at 29 to maintain the temperature of the exiting stream below the $T_g$ or $T_m$ of the toner particles. The exiting stream temperature has been shown to determine the final moisture content of the dry toner particles, with a higher temperature providing a lower final moisture content. Effective exiting stream temperatures have been found to be in the range of about 12° C. below $T_g$ to about 1° C. above $T_g$, and more preferably from about 8° C. to about 3° C. below $T_g$, although any suitable exiting stream temperatures can be used.

The dry toner particles are collected in any suitable known manner such as by cyclonic collection methods or using a bag house or dust collector.

Figure 4:
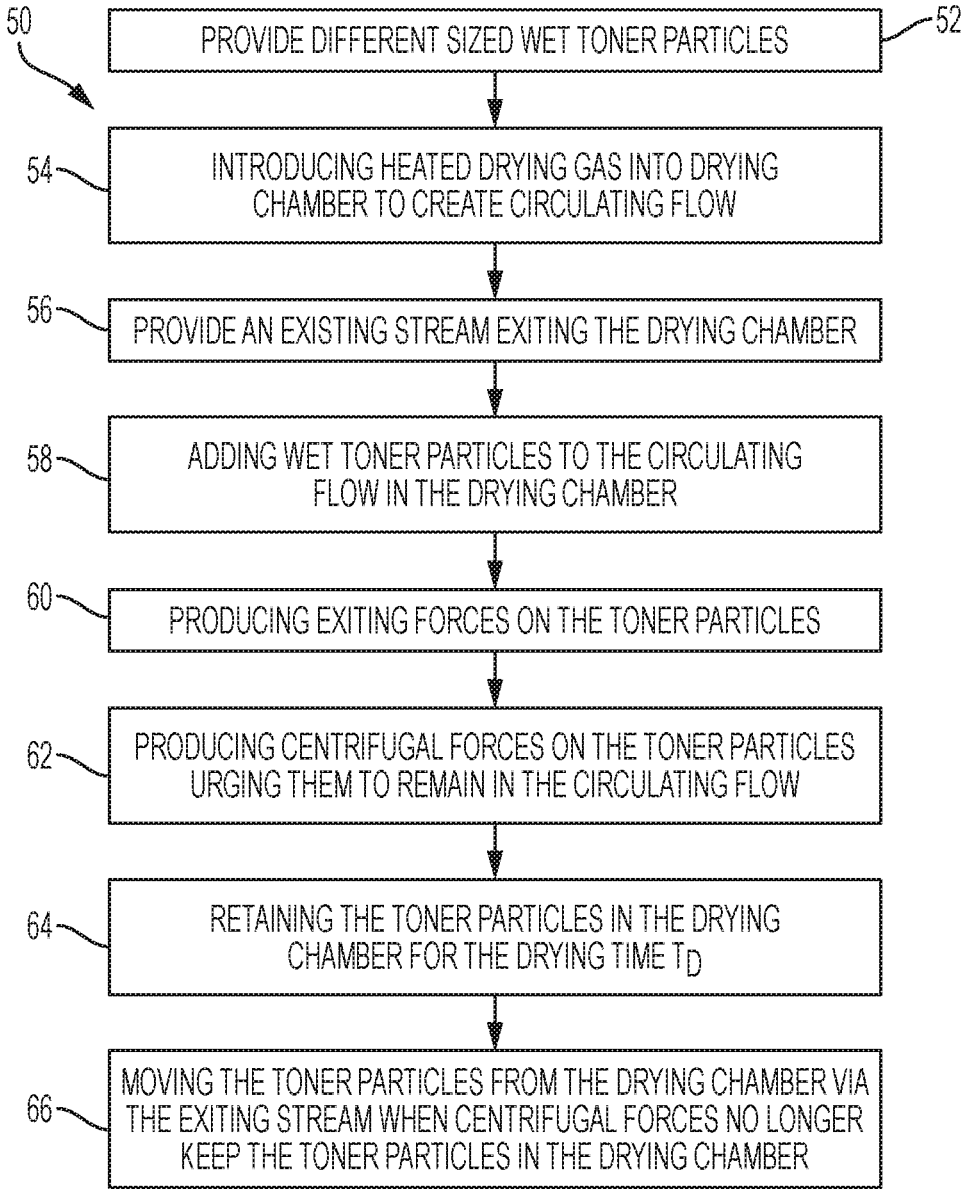
FIG. 4 illustrates a method of drying toner according to an exemplary embodiment of this disclosure.

Referring now to FIG. 4, the method of drying wet chemical toner particles is shown generally at 50. The method includes providing different sized wet toner particles to be dried, such as those described above, at 52. The wet toner particles are added to a dryer at 58 and dried for a drying time $T_D$ at 64. The drying $T_D$ is proportional to the size of the toner particle so that a larger toner particle is dried for a longer drying time than a smaller toner particle. The drying time $T_D$ is also proportional to the amount of moisture retained by each toner particle so that a toner particle retaining more water is dried for a longer drying time than a toner particle retaining less water.

The method of drying toner particles can also include introducing a heated drying gas into the drying chamber of a dryer to create a circulating flow of drying gas within the dryer at 54. The circulating flow preferably includes a curved portion as described above. The adding step can also include introducing the wet toner particles into the circulating flow of drying gas.

The method also includes providing an exiting stream of the drying gas exiting the drying chamber at 56. The exiting stream 28, described above, carries the dry toner particles out of the drying chamber 12.

The method also includes producing exiting forces on the toner particles in the circulating flow of drying gas at 60, for urging the toner particles to exit the dryer as described above. Further, producing centrifugal forces on the toner particles in the curved portion of the circulating flow of drying gas for urging the toner particles to remain in the circulating flow of drying gas within the dryer at 62. The centrifugal forces oppose the exiting forces as described above. The magnitudes of the centrifugal forces are proportional to the amounts of moisture retained by the toner particles as described above.

The method also includes moving the toner particles from the drying chamber via the exiting stream at 66 when the centrifugal forces on the toner particles no longer keep the toner particles in the circulating flow of drying gas. As they dry, the wet toner particles retain less water and thus have less mass as defined below. As the mass of the wet toner particles is reduced, the centrifugal forces exerted on them, which tend to keep them in the circulating flow, are reduced. When the toner particles are dry the centrifugal forces $F_C$ can no longer keep the toner particles in the circulating stream and the exiting forces $F_E$ move the toner particles out of the drying chamber. The dry toner particles are collected in any suitable known manner such as by cyclonic collection methods or using a bag house or dust collector.

Now further described are the fluid jets 46, i.e., water, toner drying process as previously described. The disclosed exemplary embodiments provide superior results compared with conventional methods of drying toner and conventional toner drying apparatuses, including the reduction of particle fusion. Toner particles dried with the aid of fluid jets exhibit good flow with compressibility from about 42 to about 48, and cohesivity from about 20 to about 28. Further toner particles dried using the disclosed exemplary embodiments exhibit desired morphology for blade cleaning at about 20 kpv. The toner particles dried in accordance with the disclosure are typically rougher than particles dried via conventional vacuum or plate dryers. Toner particles dried in accordance with the disclosure typically have significantly lower Crease MFT than the same toner dried in conventional fluid bed or vacuum dryers. The Crease 80 MFT (performed via free belt nip fuser in J paper) of toner particles dried in accordance with the disclosure is typically about 10° C. to about 15° C. lower than those via conventional fluid bed or vacuum dryers.

This disclosure and the exemplary embodiments described herein also provides superior deagglomeration of the toner particles 33 resulting in improved toner particle flow characteristics. Deagglomeration, occurring mostly in the drying chamber 12, exposes the surface of each particle to enable efficient heat transfer between the particle and the heated air stream 20, 22.

It has been found that deagglomeration can be controlled by changing the particles' direction of travel and changing the amount of turbulent air in the drying chamber 12. These factors change the magnitude of the particle-to-wall and particle-to-particle collision forces in the drying chamber 12. These collision forces are typically proportional to the amount of deagglomeration of the toner particles. Larger collision forces result in more deagglomeration and smaller collision forces result in less deagglomeration. Thus, the amount of deagglomeration can be controlled by changing the inlet air pressure and/or velocity, changing the inlet angle 24, and changing the size, number, and position of the inlet air nozzles 16. For example, it has been found that, with other control variables held constant, increasing the inlet air pressures and/or velocities increases deagglomeration and decreasing them decreases deagglomeration.

Figure 5:
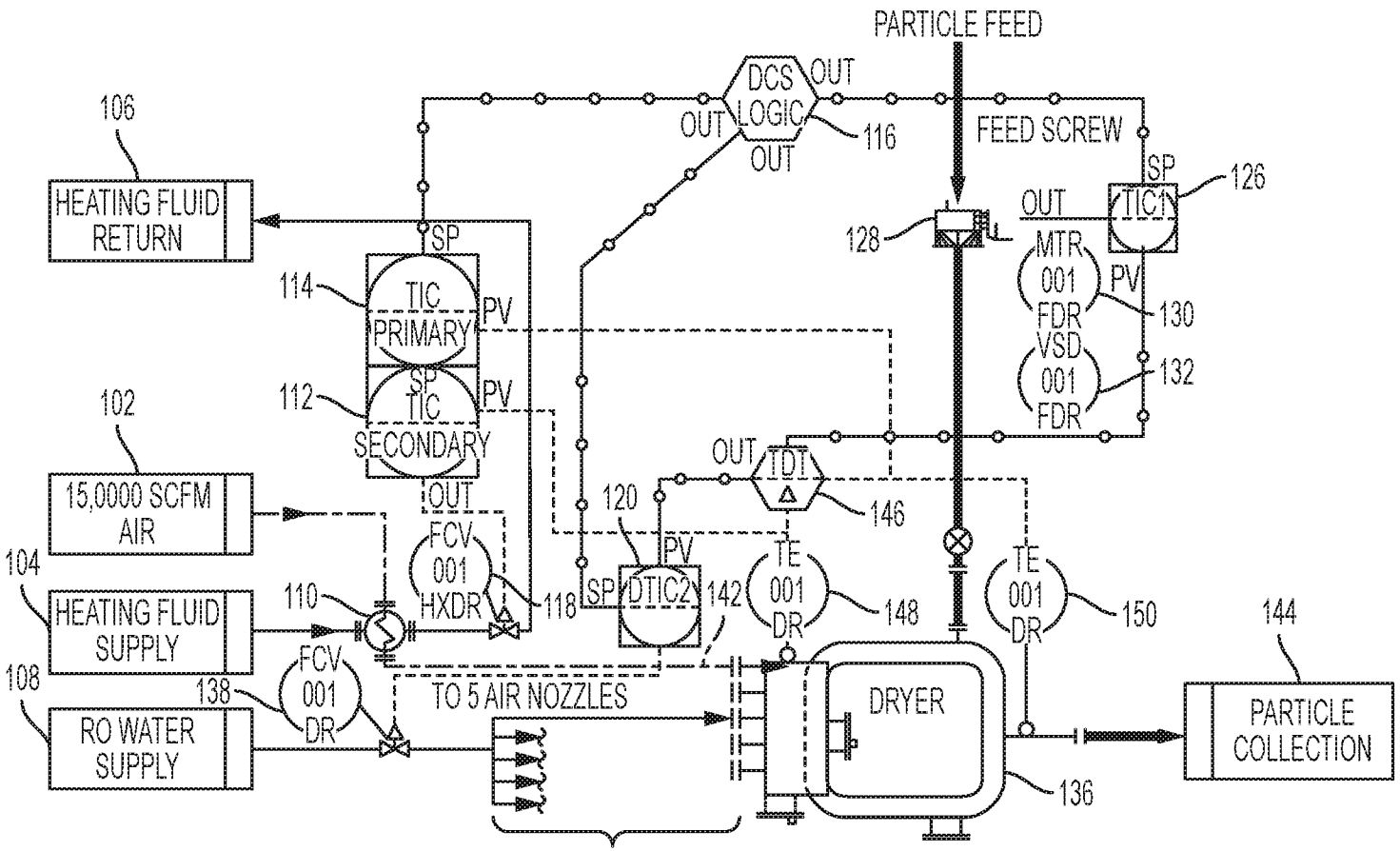
FIG. 5 is a schematic of a toner feeder and dryer system according to an exemplary embodiment of this disclosure.

With reference to FIG. 5, illustrated is a schematic of a toner feeder and dryer system according to an exemplary embodiment of this disclosure.

As shown, the toner feeder and dryer system includes a toner dryer chamber 136 including 5 air injection nozzles 142 operatively controlled by secondary controller 112 which controls flow control valve 118 which controls the flow of air from air supply 102 which is heated by a heating fluid supply 104 exchanger 110 and return 106 system. Water injector nozzles 140 inject a water mist into the dryer 136, where RO water supply 108, flow control valve 138 and controller 120 control the rate of water injected to the toner dryer 136.

Other components of the toner dryer system include a main DCS (Distributed Control System) controller 116 and associated logic implemented to control/monitor a toner feed system including a toner feed screw 128, controller 126, and motors 130 and 132. In addition, the DCS controller 116 is operatively associated with controller 120 to control the flow of water injected into the toner dryer chamber and primary controller 114 which is operatively associated with monitoring temperatures of injected air at the inlet of the dryer chamber 136 and outlet of the dryer chamber 136. A dried toner particle collection process 144 collects dryer toner from the toner dryer chamber 136.

The dryer outlet temperature should operate between 40° C. and 46° C. while feeding wet cake to maintain output particle product quality. If the outlet temperature is too low then particle moisture concentration will be too high. If the outlet temperature is too high then the particles can fuse to hot equipment surfaces and each other, forming unacceptable, coarser particles. As moisture loading inside the dryer increases, either due to wet cake feeding or false loading with RO water 108, the cascade control PID loops $TIC_{primary}$ 114 and $TIC_{secondary}$ 112 will increase the dryer inlet temperature by increasing hot glycol flow through the heat exchanger 110 to maintain a constant outlet temperature.

For the dryer feed controllers (TIC1 126 and TIC2 120), when the DTIC controller logic 116 is in auto mode, PID control is enabled, and the output control device is manipulated to minimize the difference between the calculated dryer temperature delta and the set point from the DCS 116. When the controller is in manual mode, the output device is manipulated directly from the DCS logic. The higher the output from either TIC1 126 or TIC2 120, the higher the moisture loading in the dryer will be. The target delta temperature set points are selected such that dryer feed rates keep pace with both upstream and downstream operations.

The dryer modes of operation shown in Table 1 of FIG. 6 indicates how the DTIC1 126 and DTIC2 120 controllers are utilized by the DCS logic 116 at different stages in the drying process. Conventionally, mode 1 was the only option conventionally available to start feeding the dryer and slowly ramp feed rate up to the targeted steady state temperature delta. Mode 5 was the only option to slowly ramp down and stop feeding the dryer. With the use of the added fluid misting to supplement the control of the toner dryer, the order of operating modes are mode 2 to quickly ramp dryer up to target delta, and then switching to mode 3 to start drying wet cake already at steady state temperatures. When feed wet cake is depleted, then the dryer will switch to mode 4, switching back to water feed, and then mode 6 to quickly ramp the dryer down with water feed.

Figure 7:
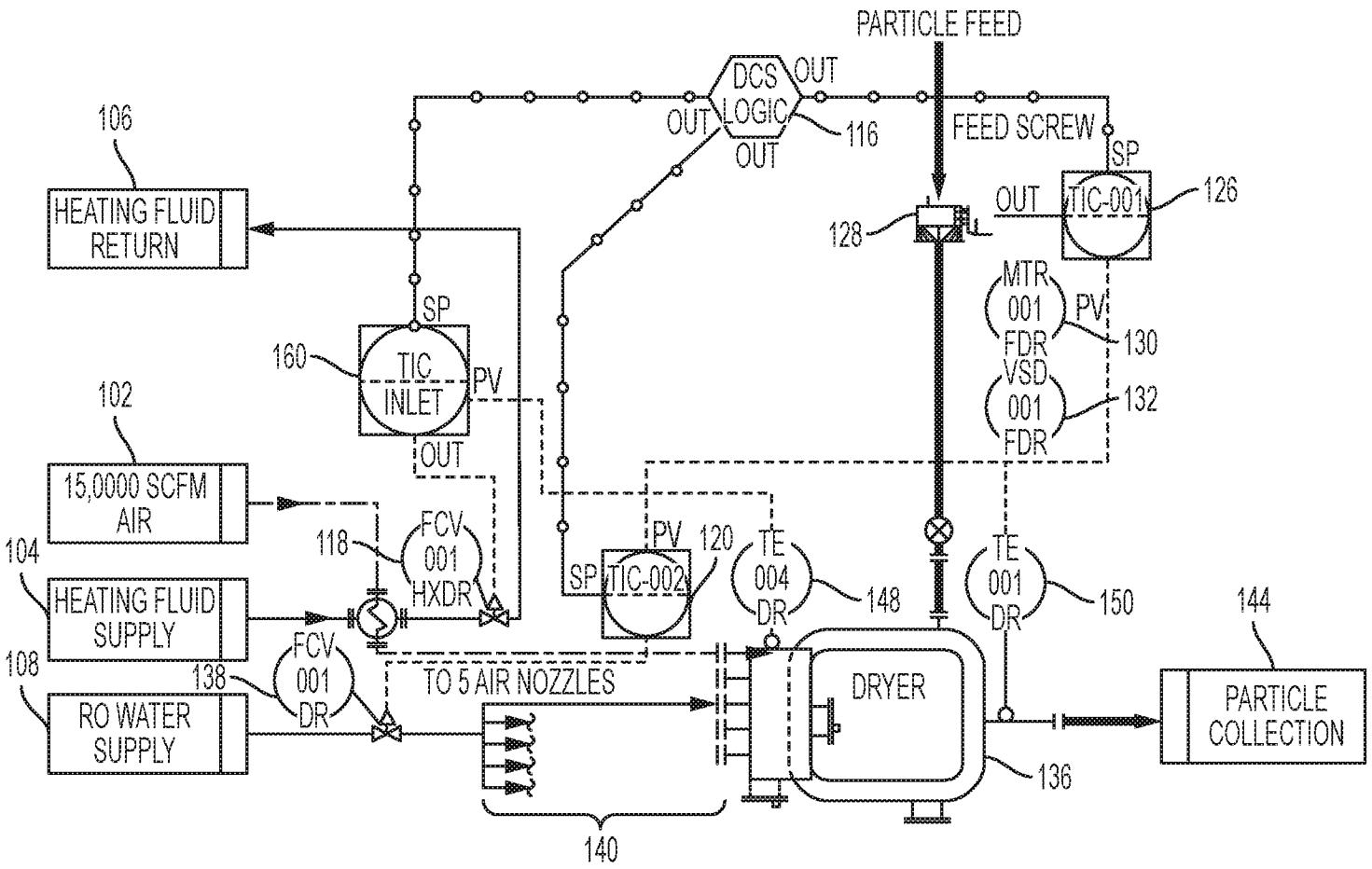
FIG. 7 is a schematic of a toner feeder and dryer system according to another exemplary embodiment of this disclosure.

With reference to FIG. 7, illustrated is a schematic of a toner feeder and dryer system according to another exemplary embodiment of this disclosure. The toner feeder and dryer system of FIG. 5 uses a cascade control scheme where the primary process variable for TIC Primary 114 is outlet temperature and the secondary process variable for TIC Secondary 112 is the inlet temperature. Separate controllers, DTIC1 126 and DTIC2 120, are used to control the delta value, at TDT 146, between the inlet and outlet temperatures by varying the feed rates of the wet cake or water. This scheme works well when there is a constant moisture content in the cake and a constant supply pressure of water for the false loading. The control scheme in FIG. 7 decouples control of the inlet temperature from control of the outlet temperature. Variations in the moisture content of the wet cake and variations in the supply pressure of the water are compensated for directly by the outlet controllers, TIC-001 126 or TIC-002 120, resulting in less overall variation of the outlet temperature. The delta between outlet and inlet temperature is only controlled incidentally as a result of the difference in the set points (SP) used for inlet and outlet. The reduction in temperature variations also has the benefit of increasing the rate at which the dryer may be heated or cooled while maintaining the outlet temperature within the process tolerance.

As shown, the toner feeder and dryer system includes a toner dryer chamber 136 including 5 air injection nozzles 142 operatively controlled by secondary controller 112 which controls flow control valve 118 which controls the flow of air from air supply 102 which is heated by a heating fluid supply 104 exchanger 110 and return 106 system. Water injector nozzles 140 inject a water mist into the dryer 136, where RO water supply 108, flow control valve 138 and controller 120 control the rate of water injected to the toner dryer 136.

Other components of the toner dryer system include a main DCS (Distributed Control System) controller 116 and associated logic implemented to control/monitor a toner feed system including a toner feed screw 128, controller 126, and motors 130 and 132. In addition, the DCS controller 116 is operatively associated with controller 120 to control the flow of water injected into the toner dryer chamber and TIC controller 160 which is operatively associated with monitoring temperatures of injected air at the inlet of the dryer chamber 136 and outlet of the dryer chamber 136. A dried toner particle collection process 144 collects dryer toner from the toner dryer chamber 136.

The dryer outlet temperature should operate between 40° C. and 46° C. while feeding wet cake to maintain output particle product quality. If the outlet temperature is too low then particle moisture concentration will be too high. If the outlet temperature is too high then the particles can fuse to hot equipment surfaces and each other, forming unacceptable, coarser particles. As moisture loading inside the dryer increases, either due to wet cake feeding or false loading with RO water 108, the TIC controller 160 will increase the dryer inlet temperature by increasing hot glycol flow through the heat exchanger 110 to maintain a constant outlet temperature.

For the dryer feed controllers (TIC1 126 and TIC2 120), when the DTIC controller logic 116 is in auto mode, PID control is enabled, and the output control device is manipulated to minimize the difference between the calculated dryer temperature delta and the set point from the DCS 116. When the controller is in manual mode, the output device is manipulated directly from the DCS logic. The higher the output from either TIC1 126 or TIC2 120, the higher the moisture loading in the dryer will be. The target delta temperature set points are selected such that dryer feed rates keep pace with both upstream and downstream operations.

The dryer modes of operation shown in Table 2 of FIG. 8 indicates how the DTIC1 126 and DTIC2 120 controllers are utilized by the DCS logic 116 at different stages in the drying process. Conventionally, mode 1 was the only option conventionally available to start feeding the dryer and slowly ramp feed rate up to the targeted steady state temperature delta. Mode 5 was the only option to slowly ramp down and stop feeding the dryer. With the use of the added fluid misting to supplement the control of the toner dryer, the order of operating modes are mode 2 to quickly ramp dryer up to target delta, and then switching to mode 3 to start drying wet cake already at steady state temperatures. When feed wet cake is depleted, then the dryer will switch to mode 4, switching back to water feed, and then mode 6 to quickly ramp the dryer down with water feed.

Figure 9:
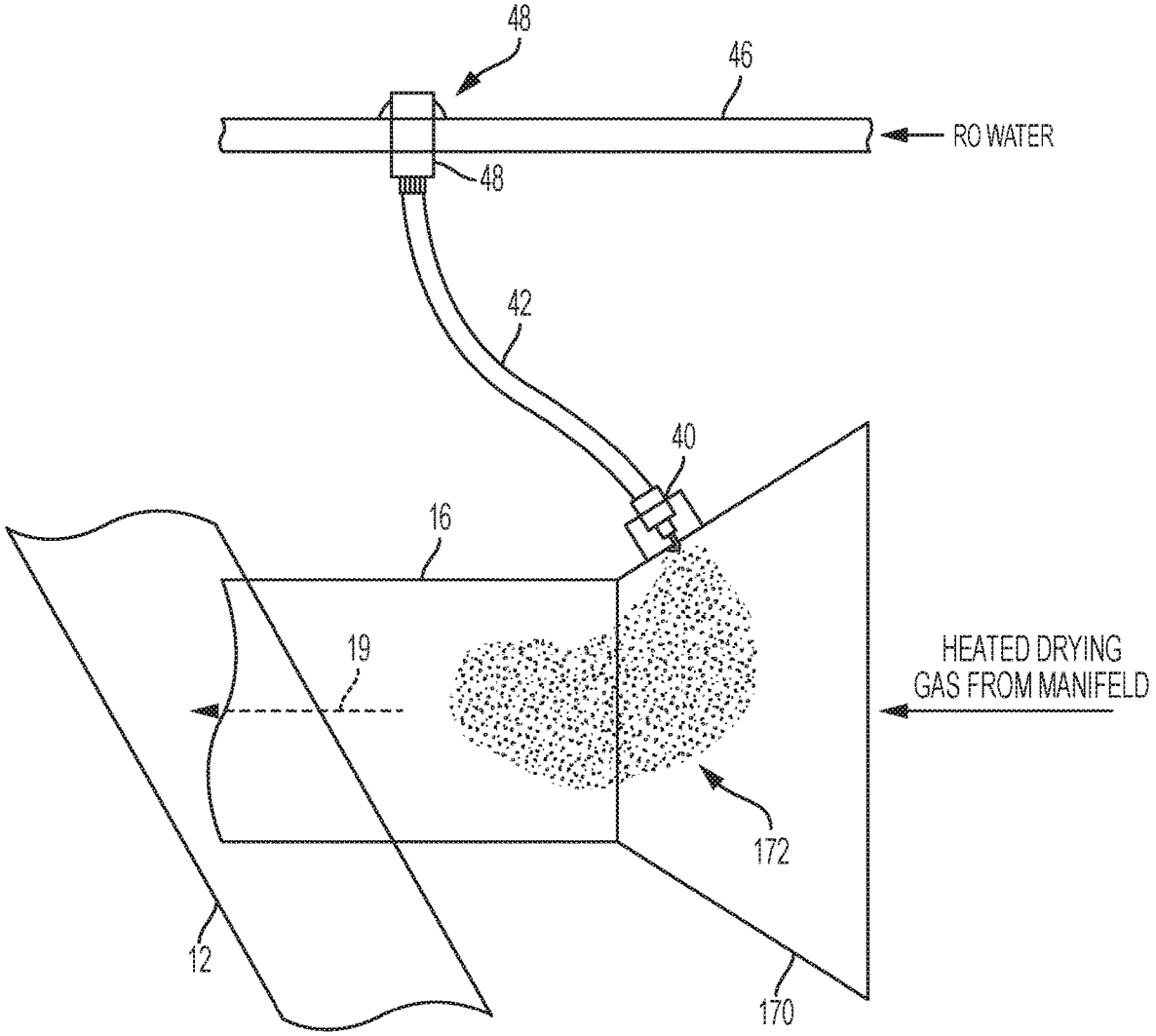
FIG. 9 is a diagram of a toner dryer nozzle cone with an integrated fluid inlet injector according to an exemplary embodiment of this disclosure.

With reference to FIG. 9, shown is a detail view of one exemplary example of a toner dryer nozzle cone 170 with an integrated fluid inlet injector 40 according to an exemplary embodiment of this disclosure.

According to the exemplary embodiment, the heated drying gas is delivered to the toner drying chamber 12 via the inlets 16 at a pressure of 1.0-psi to 5.00-psi and a rate of 3,000-5000 feet per minute. Cooling fluid from the misting nozzles 40 is provided to the toner drying chamber at a pressure of 10-psi to 50-psi, preferably from 20-psi to 30-psi, and a rate of 1 litre/minute to 100 litres/minute.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. It will be appreciated that a variety of programming languages may be used to implement the teachings of the exemplary embodiment as described herein.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; and electrical, optical, acoustical or other form of propagated signals (e.g., carrier waves, infrared signals, digital signals, etc.), just to mention a few examples.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A toner drying apparatus comprising:

a toner drying chamber including one or more curved inner radius portions;

one or more drying gas inlets operatively connected to the toner drying chamber adapted to provide drying gas at a first temperature into the toner drying chamber and generate a circulating flow of chamber gas within the toner drying chamber;

a toner feed inlet operatively connected to the toner drying chamber, the toner feed inlet adapted to feed wet toner particles into the circulating flow of chamber gas;

one or more cooling fluid inlets operatively connected to the toner drying chamber adapted to provide cooling fluid at a second temperature less than the drying gas first temperature circulating flow of the chamber gas within the toner drying chamber;

a toner outlet operatively connected to the toner drying chamber, the toner outlet adapted to direct an exiting stream of the chamber gas from the drying chamber generating exiting forces on dry toner particles in the circulating flow of chamber gas thereby transporting the dry toner particles from the toner drying chamber; and a controller operatively associated with the one or more drying gas inlets and the one or more cooling fluid inlets, the controller configured to control one or both of a flow rate and the second temperature of the cooling fluid provided into the toner drying chamber, thereby effecting a change in a temperature of the circulating flow of the chamber gas within the toner drying chamber, wherein the controller is configured to switch from a drying mode to a false load mode by injecting cooling fluid operating as a false load into the circulating flow of chamber gas as a feed rate of the wet toner particles ramps down.

2. The toner drying apparatus according to claim 1, wherein the toner drying chamber is toroidal shaped.

3. The toner drying apparatus according to claim 1, wherein the wet toner particles are associated with a chemical toner process.

4. The toner drying apparatus according to claim 1, wherein the cooling fluid is water injected as a mist into the toner drying chamber.

5. The toner drying apparatus according to claim 1, wherein the drying gas is air.

6. The toner drying apparatus according to claim 1, wherein the controller is further configured to control one or more of the drying gas first temperature and a flow rate of the drying gas.

7. The toner drying apparatus according to claim 1, wherein the controller is further configured to control one or both of the flow rate and the second temperature associated with the cooling fluid based on a feed rate of wet toner particles into the circulating flow of chamber gas.

8. The toner drying apparatus according to claim 1, wherein the drying gas is provided into the toner drying chamber at a pressure of 1.0-psi (pounds per square inch) to 5.0-psi.

9. The toner drying apparatus according to claim 1, wherein the drying gas is provided into the toner drying chamber at a rate of 3,000 feet per minute to 5,000 feet per minute.

10. The toner drying apparatus according to claim 1, wherein the cooling fluid is provided into the toner dryer chamber at a pressure of 10-psi to 50-psi.

11. The toner drying apparatus according to claim 1, wherein the cooling fluid is provided into the toner drying chamber at a rate of 1-litre/minute to 100-litres/minute.

12. The toner drying apparatus according to claim 1, the controller configured to increase the temperature of the circulating flow of chamber gas as a total moisture content of the wet toner particles fed into the circulating flow of chamber gas increases, and decrease the temperature of the circulating flow of chamber gas as a total moisture content of the wet toner particles fed into the circulating flow of chamber gas decreases by injecting cooling fluid into the circulating flow of chamber gas.

13. The toner drying apparatus according to claim 1, further comprising:

a heat exchanger operatively connected to the drying gas and adapted to control the first temperature of the drying gas.

14. A toner dryer comprising:

a toroidal shaped toner drying chamber including a plurality of curved inner radius portions;

a plurality of drying air inlets operatively connected to the toner drying chamber adapted to provide drying air at a first temperature into the toner drying chamber and generate a circulating flow of chamber air within the toner drying chamber;

a toner feed inlet operatively connected to the toner drying chamber, the toner feed inlet adapted to feed wet toner cakes into the toner drying chamber;

a plurality of cooling fluid inlets operatively connected to the toner drying chamber adapted to inject water mist at a second temperature less than the first temperature into the toner drying chamber and into the circulating flow of the chamber air;

a toner outlet operatively connected to the toner drying chamber, the toner outlet adapted to direct an exiting stream of the chamber air from the drying chamber generating exiting forces on dryer toner particles in the circulating flow of chamber air thereby transporting the dry toner particles from the toner drying chamber; and a controller operatively associated with the plurality of drying air inlets and the plurality of cooling fluid inlets, the controller configured to control a flow rate and the second temperature of the injected water mist into the toner drying chamber, thereby effecting a change in a temperature of the circulating flow of the chamber air within the toner drying chamber, wherein the controller is configured to increase the temperature of the circulating flow of chamber gas as a total moisture content of the wet toner particles fed into the circulating flow of chamber gas increases, and decrease the temperature of the circulating flow of chamber gas as a total moisture content of the wet toner particles fed into the circulating flow of chamber gas decreases by injecting cooling fluid into the circulating flow of chamber gas, wherein the controller is configured to preheat the toner drying chamber prior to feeding wet toner particles into the circulating flow of chamber gas, the controller configured to inject cooling fluid operating as a false load into the circulating flow of chamber gas and inject drying gas into the circulating flow of chamber gas, and wherein the controller is configured to switch from a drying mode to a false load mode by injecting cooling fluid operating as a false load into the circulating flow of chamber gas as a feed rate of the wet toner particles ramps down.

15. The toner drying apparatus according to claim 14, wherein the wet toner particles are associated with a chemical toner process.

16. The toner drying apparatus according to claim 14, wherein the drying gas is provided into the toner drying chamber at a pressure of 1.0-psi (pounds per square inch) to 5.0-psi.

17. The toner drying apparatus according to claim 14, wherein the drying gas is provided into the toner drying chamber at a rate of 3,000 feet per minute to 5,000 feet per minute.

18. The toner drying apparatus according to claim 14, wherein the cooling fluid is provided into the toner dryer chamber at a pressure of 10-psi to 50-psi.

19. The toner drying apparatus according to claim 14, wherein the cooling fluid is provided into the toner drying chamber at a rate of 1-litre/minute to 100-litres/minute.

20. The toner drying apparatus according to claim 14, further comprising:

a heat exchanger operatively connected to the drying gas and adapted to control the first temperature of the drying gas.

* * * * *